US006968993B1

(12) United States Patent
Russell

(10) Patent No.: US 6,968,993 B1
(45) Date of Patent: Nov. 29, 2005

(54) MAILBOX ASSEMBLY

(76) Inventor: John Russell, 7222 Skyline Dr., San Diego, CA (US) 92114

( * ) Notice: Subject to any disclaimer, the term of this patent is extended or adjusted under 35 U.S.C. 154(b) by 57 days.

(21) Appl. No.: 10/713,462

(22) Filed: Nov. 17, 2003

(51) Int. Cl.[7] ..... B65D 91/00
(52) U.S. Cl. ..... 232/17; 232/38; 312/1
(58) Field of Search ..... 232/17, 43.1, 45, 232/38; 312/1

(56) References Cited

U.S. PATENT DOCUMENTS

| | | | | |
|---|---|---|---|---|
| 3,084,684 | A | 4/1963 | Saunders | |
| 3,267,830 | A | 8/1966 | Gaasbeck | |
| 5,262,578 | A | 11/1993 | Hall | |
| 5,316,733 | A * | 5/1994 | Rune et al. | 422/104 |
| 5,425,501 | A | 6/1995 | Wesorick | |
| 5,594,200 | A | 1/1997 | Ramsey | |
| 6,517,429 | B1 * | 2/2003 | O'Connell et al. | 454/56 |
| 6,573,836 | B1 * | 6/2003 | Gitis et al. | 340/603 |
| 6,592,026 | B2 * | 7/2003 | Vilardi | 232/17 |
| 6,660,227 | B2 * | 12/2003 | Lopez Ordaz | 422/24 |
| 2003/0070404 | A1 * | 4/2003 | Calabrese | 55/385.2 |
| 2003/0076011 | A1 * | 4/2003 | Brownfiel | 312/1 |
| 2003/0086818 | A1 * | 5/2003 | Holley et al. | 422/24 |
| 2003/0103881 | A1 * | 6/2003 | Lane et al. | 422/292 |
| 2003/0136823 | A1 * | 7/2003 | Felice et al. | 232/30 |
| 2003/0193272 | A1 * | 10/2003 | Bryan | 312/1 |
| 2003/0205614 | A1 * | 11/2003 | Klima et al. | 232/38 |

FOREIGN PATENT DOCUMENTS

GB 2382621 * 4/2003

OTHER PUBLICATIONS

Anthrax Abater Press Release, Oct. 24, 2004.*

* cited by examiner

*Primary Examiner*—William L. Miller

(57) ABSTRACT

A mailbox assembly includes a housing including a bottom wall, a first side wall, a second side wall, and a back wall. A front wall is hingedly coupled to the housing and defines a first door for selectively opening or closing the housing. A top wall is attached to the first and second side walls. The top wall is substantially transparent. A window is positioned in the first side wall and comprises a substantially transparent material. The window has a pair of apertures extending therethrough. Each of a pair of gloves has a wrist portion and a hand portion. Each of the wrist portions is attached to and extending along a perimeter edge of one of the apertures such that each of the gloves extends into housing.

12 Claims, 5 Drawing Sheets

MAILBOX ASSEMBLY

BACKGROUND OF THE INVENTION

1. Field of the Invention

The present invention relates to mailbox devices and more particularly pertains to a new mailbox device that allows a user of the mailbox to inspect the interior of the mailbox before removing any contents therein.

2. Description of the Prior Art

The use of mailbox devices is known in the prior art. While these devices fulfill their respective, particular objectives and requirements, the need remains for a mailbox that allows a user of the mailbox to see the interior of the mailbox and such a device should also include the ability to manipulate the contents of the mailbox.

SUMMARY OF THE INVENTION

The present invention meets the needs presented above by generally comprising a housing including a bottom wall, a first side wall, a second side wall, and a back wall. A front wall is hingedly coupled to the housing and defines a first door for selectively opening or closing the housing. A top wall is attached to the first and second side walls. The top wall is substantially transparent. A window is positioned in the first side wall and comprises a substantially transparent material. The window has a pair of apertures extending therethrough. Each of a pair of gloves has a wrist portion and a hand portion. Each of the wrist portions is attached to and extending along a perimeter edge of one of the apertures such that each of the gloves extends into housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
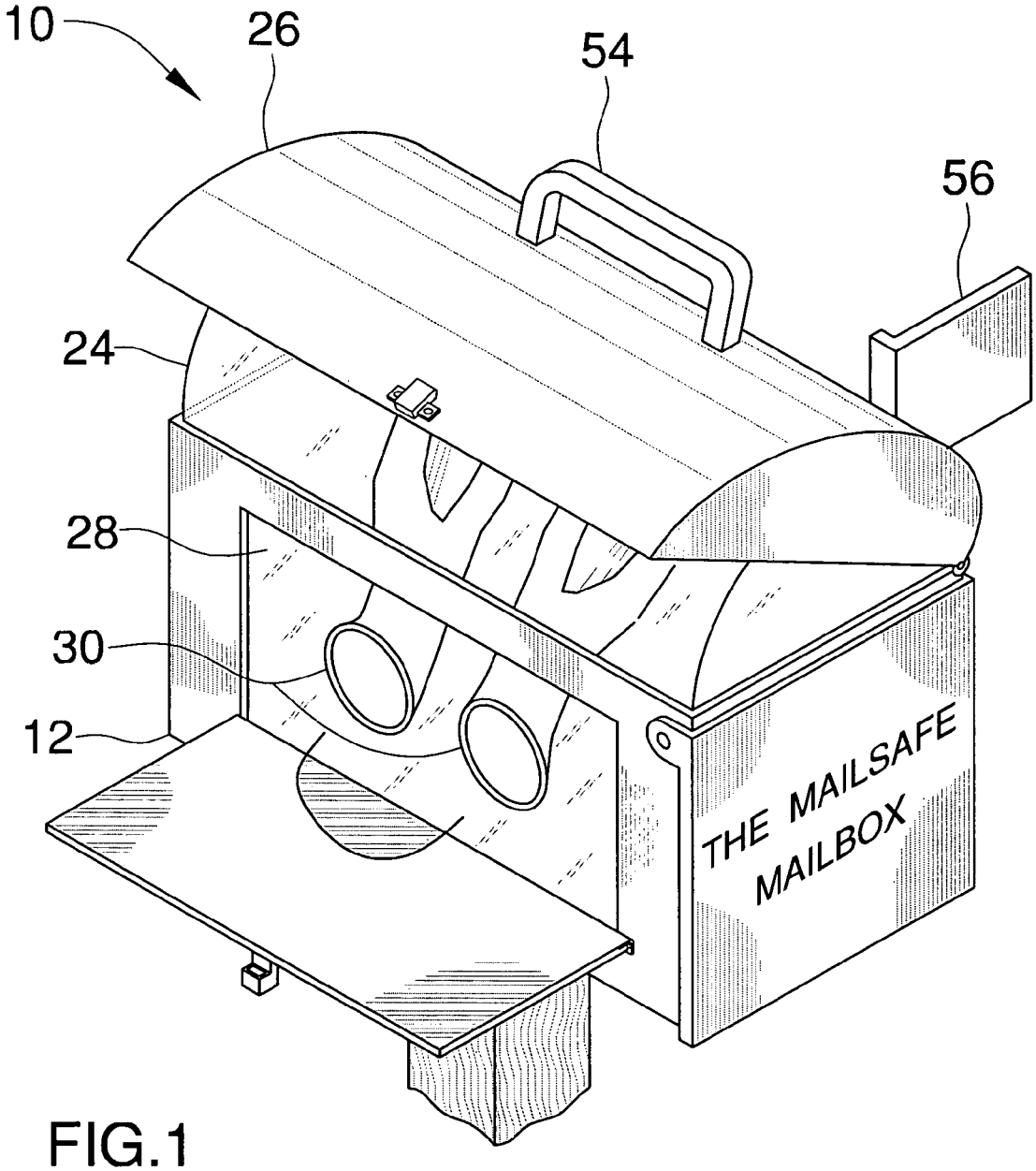
FIG. 1 is a schematic perspective view of a mailbox assembly according to the present invention.
Figure 2:
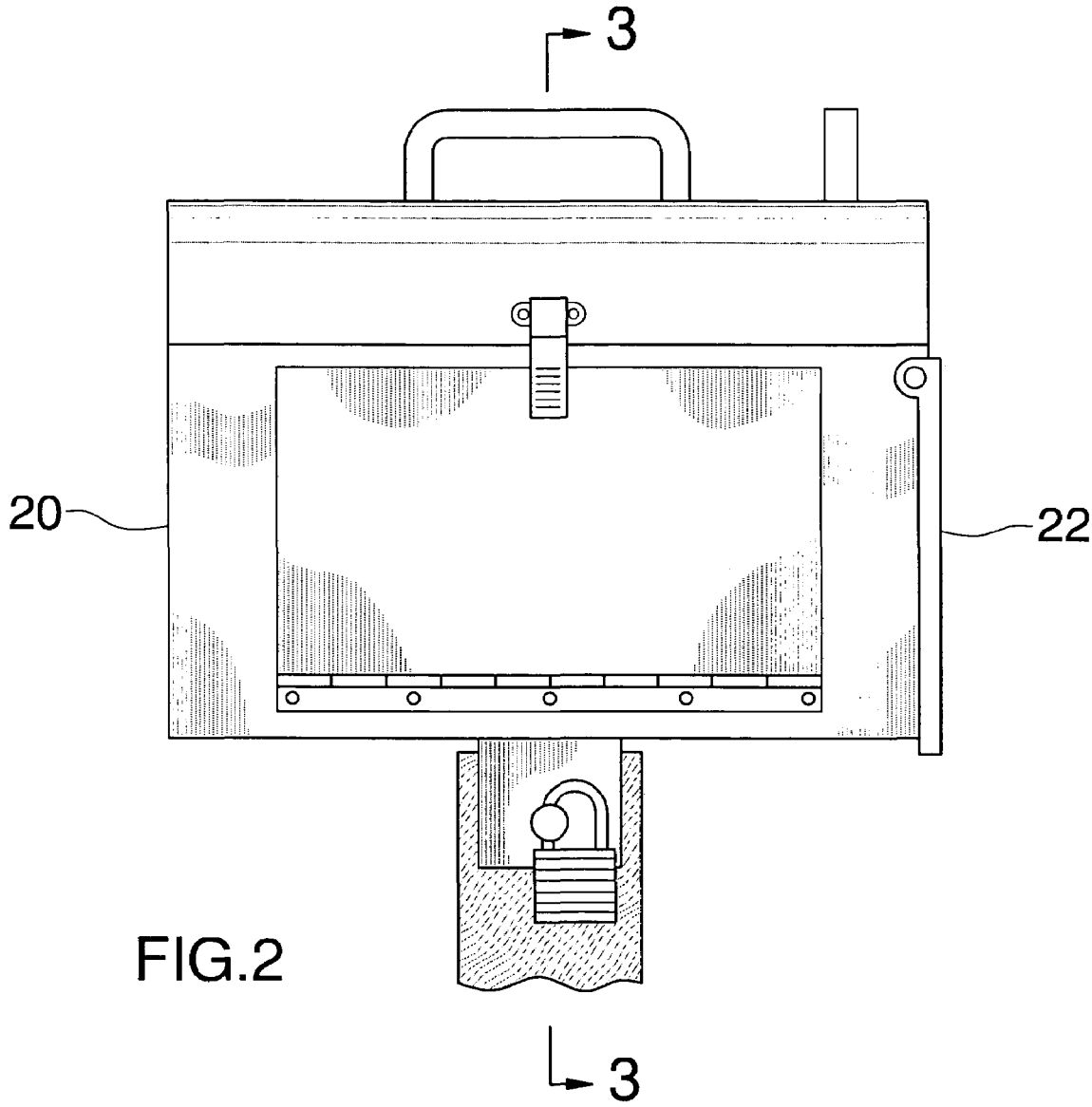
FIG. 2 is a schematic side elevational view of the present invention.
Figure 3:
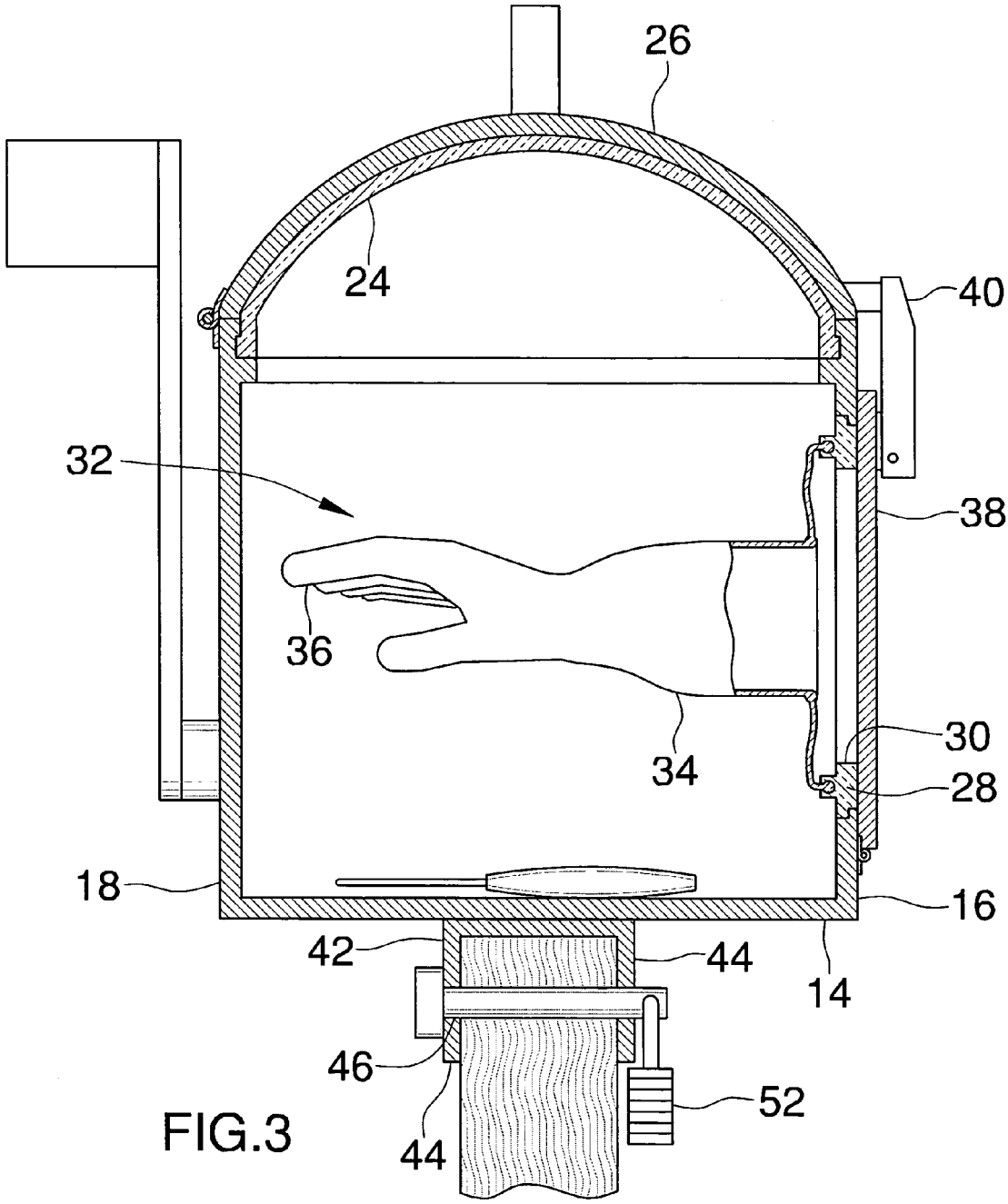
FIG. 3 is a schematic rear cross-sectional view of the present invention.
Figure 4:
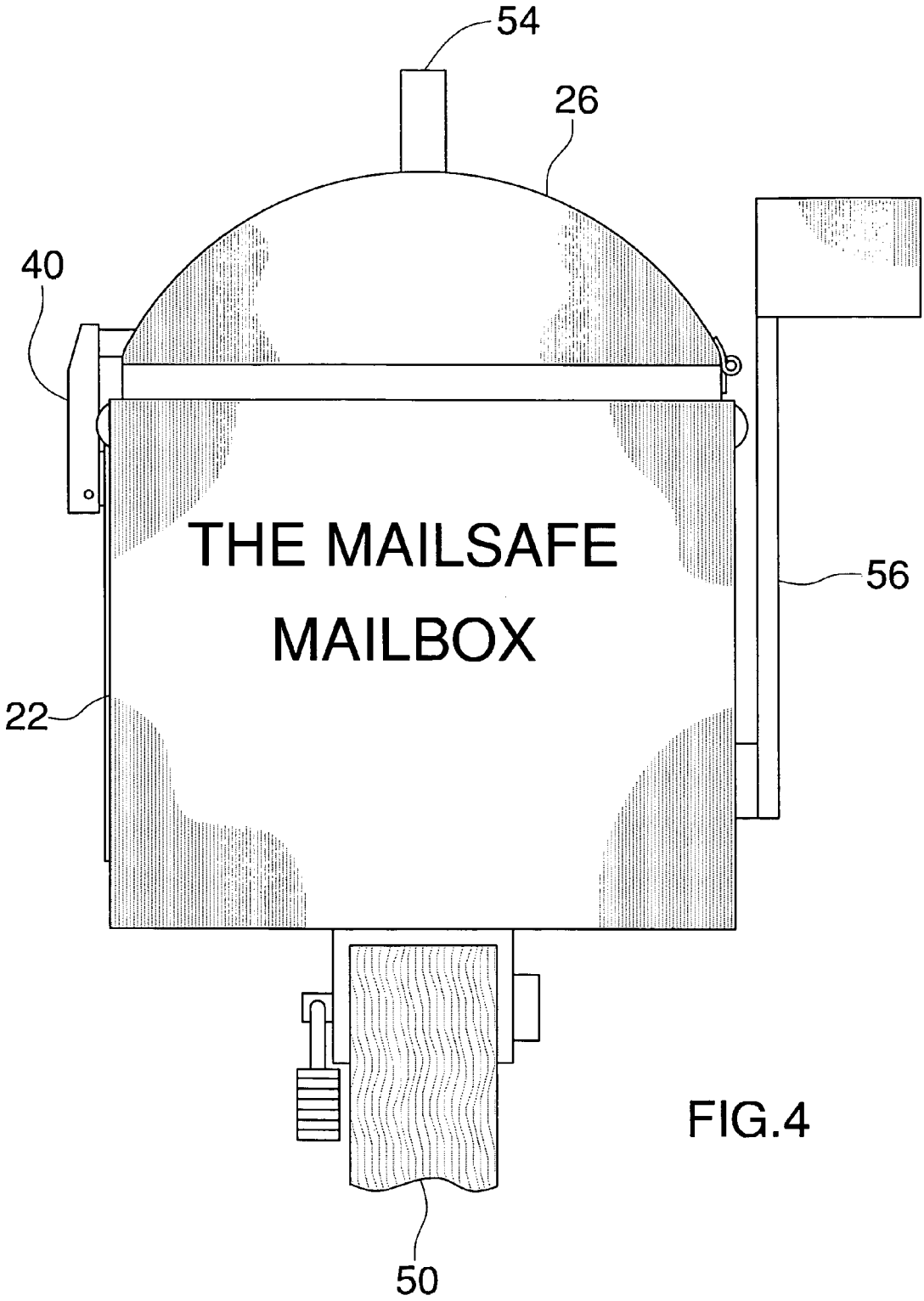
FIG. 4 is a schematic front elevational view of the present invention.
Figure 5:
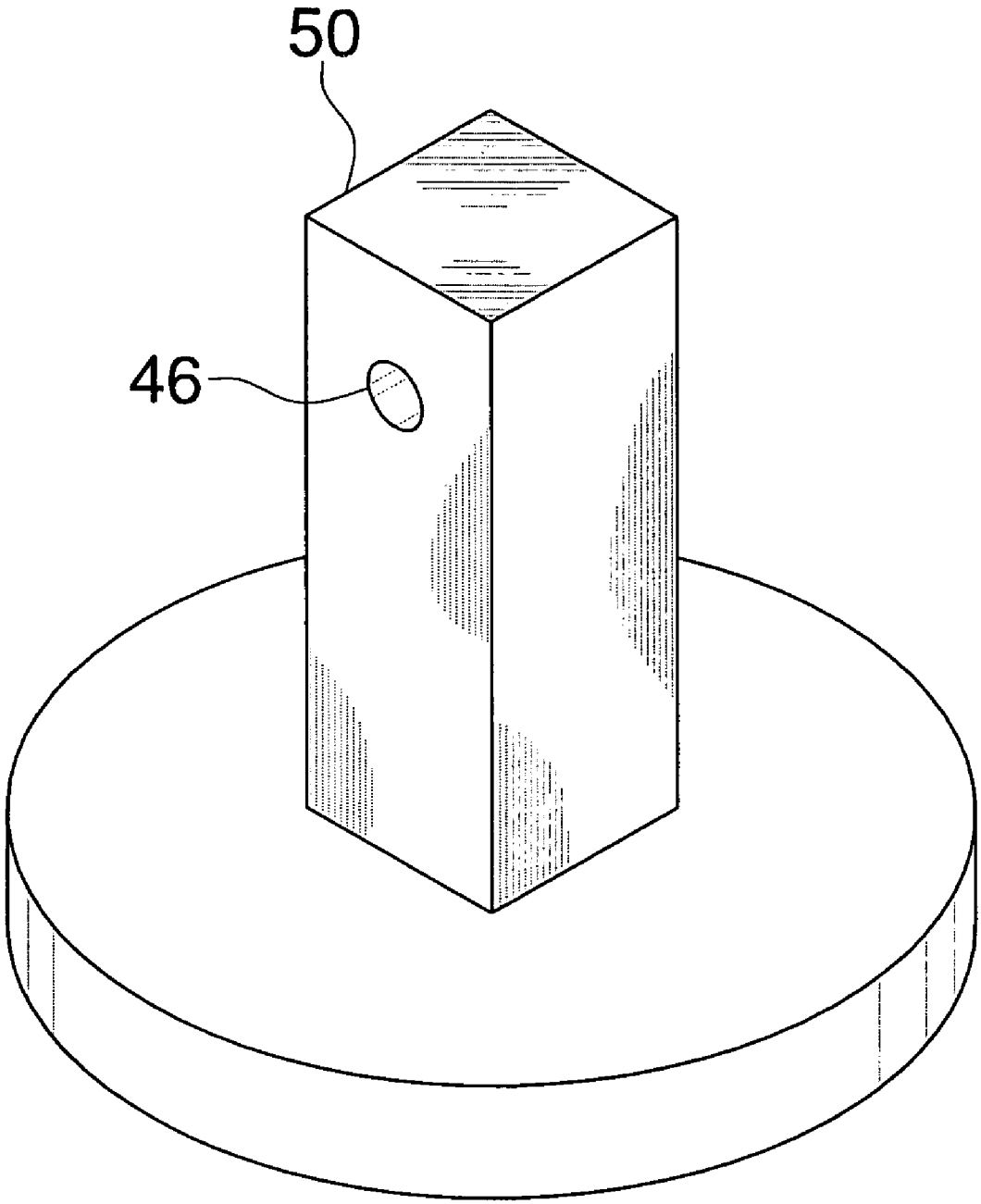
FIG. 5 is a schematic perspective view of a base of the present invention.

With reference now to the drawings, and in particular to FIGS. 1 through 5 thereof, a new mailbox device embodying the principles and concepts of the present invention and generally designated by the reference numeral 10 will be described.

As best illustrated in FIGS. 1 through 5, the mailbox assembly 10 generally comprises a housing 12 that includes a bottom wall 14, a first side wall 16, a second side wall 18, and a back wall 20. A front wall 22 is hingedly coupled to the housing 12 and defines a first door for selectively opening or closing the housing 12. A top wall 24 is attached to the first 16 and second 18 side walls. The top wall 24 is substantially transparent and is preferably arched upwardly from the first 16 and second 18 side walls. A cover 26 is hingedly coupled to the housing 12 and is selectively positionable in a closed position covering the top wall 24.

A window 28 is positioned in the first side wall 16. The window 28 comprises a substantially transparent material and preferably comprises a plastic material. The window 28 has a pair of apertures 30 extending therethrough. Each of a pair of gloves 32 has a wrist portion 34 and a hand portion 36. Each of the wrist portions 34 is attached to and extends along a perimeter edge of one of the apertures 30 such that each of the gloves 32 extends into housing 12. Preferably, each of the gloves 32 comprises an elastomeric material, though flexible plastic may also be used.

A second door 38 is hingedly coupled to the housing 12. The second door 38 is selectively positionable in a closed position covering the window 28. A securing member 40 is attached to the second door 38 and the cover 26 for selectively securing the second door 38 and the cover 26 in their respective closed positions.

A bracket 42 is attached to the bottom wall 14 for selectively attaching the housing 12 to a post 50. The bracket 42 preferably includes a pair of legs 44 extending downwardly from the housing 12. The post 50 is positioned between the legs 44. The post 50 and legs 44 each have holes 46 extending therethrough which are alignable when the bracket 42 is position on the post 50. A rod 48 is extended through the aligned holes 46 for securing the bracket 42 to the post 50. A lock 52 may be positioned on the rod 48 for locking the bracket 42 to the post 50.

Preferably, a handle 54 is attached to and extends upwardly from the cover 26. The handle 54 allows for the easy opening of the cover 26 and for carrying the housing 12 when it is removed from the post 50. The assembly 10 also includes a rigid flag 56 pivotally coupled to the housing 12 for indicating outgoing mail.

In use, the assembly 10 is generally used as a conventional mailbox. When a user of the assembly retrieves their mail, the cover 26 is opened so that user may see if there is mail within the housing 12 and to inspect for suspicious articles therein. If there are suspicious articles, the user may use the gloves 32 to manipulate the contents of the housing 12 to better inspect the contents thereof.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A mailbox assembly including:

a housing including a bottom wall, a first side wall, a second side wall, and a back wall, a front wall being hingedly coupled to said housing and defining a first door for selectively opening or closing said housing, a top wall being attached to said first and second side walls, said top wall being substantially transparent;

a window being positioned in said first side wall, said window comprising a substantially transparent material, said window having a pair of apertures extending therethrough; and a pair of gloves each having a wrist portion and a hand portion, each of said wrist portions being attached to and extending along a perimeter edge of one of said apertures such that each of said gloves, extend into housing; and a cover being hingedly coupled to said housing and being selectively positionable in a closed position covering said top wall.

2. The assembly of claim 1, wherein each of said gloves comprising an clastomeric material.

3. The assembly of claim 1, further including a second door being hingedly coupled to said housing, said second door being selectively positionable in a closed position covering said window.

4. The assembly of claim 1, further including a securing member being attached to said second door and said cover for selectively securing said second door and said cover in said closed positions.

5. The assembly of claim 1, further including a bracket being attached to said bottom wall for selectively attaching said housing to a post.

6. The assembly or claim 1, further including a handle being attached to and extending upwardly from said cover.

7. A mailbox assembly including:

a housing including a bottom wall, a first side wall, a second side wall, and a back wall, a front wall being hingedly coupled to said housing mid defining a first door for selectively opening or closing said housing, a top wall being attached to said first and second side walls, said top wall being substantially transparent;

a cover being hingedly coupled to said housing and being selectively positionable in a closed position covering said top wall;

a window being positioned in said first side wall, said window comprising a substantially transparent material, said window having a pair of apertures extending therethrough;

a pair of gloves each having a wrist portion and a hand portion, each of said wrist portions being attached to and extending along a perimeter edge of one of said apertures such that each of said gloves extend into housing, each of said gloves comprising an elastomeric material;

a second door being hingedly coupled to said housing, said second door being selectively positionable in a closed position covering said window;

a securing member being attached to said second door and said cover for selectively securing said second door and said cover in said closed positions, a bracket being attached to said bottom wall for selectively attaching said housing to a post; and a handle being attached to and extending upwardly from said cover.

8. A mailbox assembly including:

a housing including a bottom wall, a first side wall, a second side wall, and a back wall, a front wall being hingedly coupled to said housing and defining a first door for selectively opening or closing said housing, a top wall being attached to said first and second side walls, said top wall being substantially transparent;

a window being positioned in said first side wall, said window comprising a substantially transparent material, said window having a pair of apertures extending therethrough;

a second door being hingedly coupled to said housing, said second door being selectively positionable in a closed position covering said window; and a cover coupled to said housing and being selectively positionable in a closed position covering said top wall a pair of gloves each having a wrist portion and a hand portion, each of said wrist portions being attached to and extending along a perimeter edge of one of said apertures such that each of said gloves extend into housing.

9. The assembly of claim 8, wherein each of said gloves comprising an elastomeric material.

10. The assembly of claim 8, further including a securing member being attached to said second door and said cover for selectively securing said second door and said cover in said closed positions.

11. The assembly of claim 8, further including a bracket being attached to said bottom wall for selectively attaching said housing to a post.

12. The assembly of claim 8, further including a handle being attached to and extending upwardly from said cover.

* * * * *